US009841251B2

(12) United States Patent
Cheng

(10) Patent No.: US 9,841,251 B2
(45) Date of Patent: Dec. 12, 2017

(54) GUN DEVICE WITH BOLT CATCH

(71) Applicant: KRISS INDUSTRIES ASIA LTD., Taipei (TW)

(72) Inventor: Li-Te Cheng, Taipei (TW)

(73) Assignee: KRISS INDUSTRIES ASIA LTD., Taipei (TW)

( * ) Notice: Subject to any disclaimer, the term of this patent is extended or adjusted under 35 U.S.C. 154(b) by 0 days.

(21) Appl. No.: 15/198,172

(22) Filed: Jun. 30, 2016

(65) Prior Publication Data

US 2017/0184361 A1 Jun. 29, 2017

(30) Foreign Application Priority Data

Dec. 29, 2015 (TW) ..... 104221050 A

(51) Int. Cl.
*F41A 17/36* (2006.01)
*F41A 9/70* (2006.01)
*F41A 9/71* (2006.01)

(52) U.S. Cl.
CPC ..... *F41A 17/36* (2013.01); *F41A 9/70* (2013.01); *F41A 9/71* (2013.01)

(58) Field of Classification Search
CPC ..... F41A 17/36; F41A 9/70; F41A 9/71
USPC .... 89/187.01, 186, 137, 138, 180, 181, 197; 42/17, 18, 21, 22, 33, 49.01, 49.02, 49.1, 42/50, 70.02
See application file for complete search history.

(56) References Cited

U.S. PATENT DOCUMENTS 4,069,608 A * 1/1978 Jurek ..... F41A 9/71 42/49.02
4,617,749 A * 10/1986 Jurek ..... F41A 15/14 42/16
5,588,241 A * 12/1996 Hurley ..... F41A 9/65 42/18
6,212,814 B1 * 4/2001 Lambie ..... F41A 11/02 42/75.03
6,606,811 B1 * 8/2003 Olson ..... F41A 17/36 42/50
9,091,499 B2 * 7/2015 Overstreet ..... F41A 3/68
9,482,480 B2 * 11/2016 O'Dell ..... F41A 17/36
2005/0115128 A1 * 6/2005 Hahin ..... F41A 9/65 42/50
2010/0162604 A1 * 7/2010 Dubois ..... F41A 11/02 42/18
2011/0277366 A1 * 11/2011 Steffes ..... F41A 9/65 42/50

(Continued)

*Primary Examiner* — John Cooper
(74) *Attorney, Agent, or Firm* — Locke Lord LLP; Tim Tingkang Xia, Esq.

(57) ABSTRACT

A gun device with bolt catch, having a receiver including a bolt chamber and magazine well, comprising: a magazine, bolt, and bolt catch. The magazine includes a follower and bolt lock trigger. The magazine and bolt are disposed in the magazine well and bolt chamber, respectively. The bolt catch, which includes an engaging body, is disposed through a lateral surface thereof on the receiver and located at either an initial position or engaging position. Positioning the follower at a first position allows the follower to be positioned beside the bolt lock trigger, extends the bolt lock trigger from the magazine by a height, moves the bolt catch, positions the engaging body beside the bolt, positions the bolt catch at the engaging position, and fixes the bolt in place at an open position.

5 Claims, 7 Drawing Sheets

(56) References Cited

U.S. PATENT DOCUMENTS

2014/0060310 A1* 3/2014 Overstreet ..... F41A 3/68
89/138

* cited by examiner

GUN DEVICE WITH BOLT CATCH

CROSS REFERENCE

This non-provisional application claims priority from Taiwan Patent Application No. 104221050, filed on Dec. 29, 2015, the entire content thereof is incorporated by reference herein.

BACKGROUND OF THE INVENTION

Field of the Invention

The present invention relates to gun devices with bolt catch and, more particularly, to a gun device with blowback action whereby not only are 0.22 inch caliber bullets and a barrel applicable to a receiver of an AR-15 automatic rifle but the magazine is also capable of bolt catch function.

Description of the Prior Art

An automatic rifle is capable of self-loading, burst fire, and fully automatic firing. It uses its recoil or a portion of the gas propelling a projectile to remove old spent cartridge cases, load a new cartridge and fire again. Hence, once its trigger is pulled, the automatic rifle will start a burst fire, and the burst fire will not stop unless and until it runs out of bullets.

Automatic rifle manufacturers always care about the optimization and quality of automatic rifles. The dimensions of all the parts and components of conventional automatic rifles must be precisely calculated and corrected for the sake of practicability, durability and precision. The types of bullets for use by automatic rifles depend on the model numbers of the automatic rifles. As a result, there is limited universality of parts and components of conventional automatic rifles.

Firearms in use among civilians nowadays in Europe and North America are mostly AR-15 automatic rifles, 0.22 inch caliber automatic rifles, handguns, etc. AR-15 automatic rifles use bullets which are 5.56 mm in caliber and 45 mm in length, whereas 0.22 inch caliber automatic rifles use bullets which are 0.22 inch in caliber. The great difference in applicable bullets between an AR-15 automatic rifle and a 0.22 inch caliber automatic rifle renders it impossible for an AR-15 automatic rifle and a 0.22 inch caliber automatic rifle to use the same bullet. As a result, AR-15 automatic rifles differ from 0.22 inch caliber automatic rifles in a cartridge, a bolt, a barrel and even a magazine. Therefore, rifle users must choose bullets in accordance with the equipment in use.

The bullets for use with AR-15 automatic rifles surpass the bullets for use with 0.22 inch caliber automatic rifles in caliber, length, quantity of gunpowder contained, and firing range. Hence, AR-15 automatic rifles are suitable for use in medium- and long-distance field combats. By contrast, although the bullets for use with 0.22 inch caliber automatic rifles are disadvantageously dwarfed by their counterparts in caliber, length, quantity of gunpowder contained, and firing range, 0.22 inch caliber automatic rifles have their advantages, namely low recoil, low noise, and low manufacturing costs. Therefore, from a user's perspective, long use of AR-15 automatic rifles incurs much expense on bullets. Accordingly, it is important to overcome the aforesaid drawbacks of the prior art.

SUMMARY OF THE INVENTION

In view of the aforesaid drawbacks of conventional automatic rifles, the inventor of the present invention is motivated to improve the conventional automatic rifles and thereby devises a magazine structure which can use bullets of different specifications and is applicable to AR15 automatic rifles, thereby allowing AR15 automatic rifles to use 0.22 inch caliber bullets with bolt catch function.

In order to achieve the above and other objectives, the present invention provides a gun device with bolt catch, having a receiver comprising a bolt chamber and a magazine well, with an angle defined by and between a direction of extension of the bolt chamber and a direction of extension of the magazine well, comprising a magazine, a bolt, and a bolt catch. The magazine comprises a follower and a bolt lock trigger. The magazine is disposed in the magazine well. The bolt is disposed in the bolt chamber. The bolt catch comprises an engaging body. The bolt catch is disposed through a lateral surface thereof on the receiver, allowing the bolt catch to be located at an initial position and an engaging position. When the follower is located at a first position, not only is the follower positioned beside the bolt lock trigger such that the bolt lock trigger extends from the magazine by a height to thereby move the bolt catch, but the engaging body is also positioned beside the bolt to thereby position the bolt catch at the engaging position and fix the bolt in place at an open position.

In this embodiment of the present invention, the magazine further comprises a hollow, a rail, and a fixing chamber. The hollow extends from the magazine. The rail is disposed in the magazine and has an end extended to the hollow, wherein the follower lies on the rail while undergoing a linear displacement motion. The fixing chamber is disposed in the magazine and adapted to contain the bolt lock trigger.

In this embodiment of the present invention, the follower further comprises a top plate and a resilient component. The top plate has an end flanked by a positioning body and a tab, allowing the tab to lie on the rail. The resilient component connects with the positioning body. The top plate undergoes the linear displacement motion in a direction of extension of the resilient component and confined to the rail. When the follower is located at the first position, the top plate is positioned in the hollow and beside a peripheral surface of the hollow.

In this embodiment of the present invention, the follower is located at a second position, the hollow receives at least a projectile of first caliber, and the first caliber is 0.22 inch caliber. The peripheral dimension of the magazine is a second specification magazine dimension, and the second specification magazine dimension is 5.56 mm caliber.

In this embodiment of the present invention, the bolt lock trigger further comprises a baffle and a resilient body. The baffle is disposed in the fixing chamber, extended from an opening of the fixing chamber, and flanked by a pressing body and a guiding body. The resilient body connects with the pressing body. The baffle undergoes a second linear displacement motion in a direction of extension of the resilient body and confined to the opening. The bolt lock trigger extends from the magazine by the height such that the resilient body is compressed by the pressing body and thereby enters a pressed state.

In this embodiment of the present invention, the bolt is located at either a feed position or the open position and located at the feed position when the bolt catch is located at the initial position.

In this embodiment of the present invention, the bolt is adapted to position bullets and comprises an extractor for removing spent cartridge cases.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE EMBODIMENTS

Figure 1A:
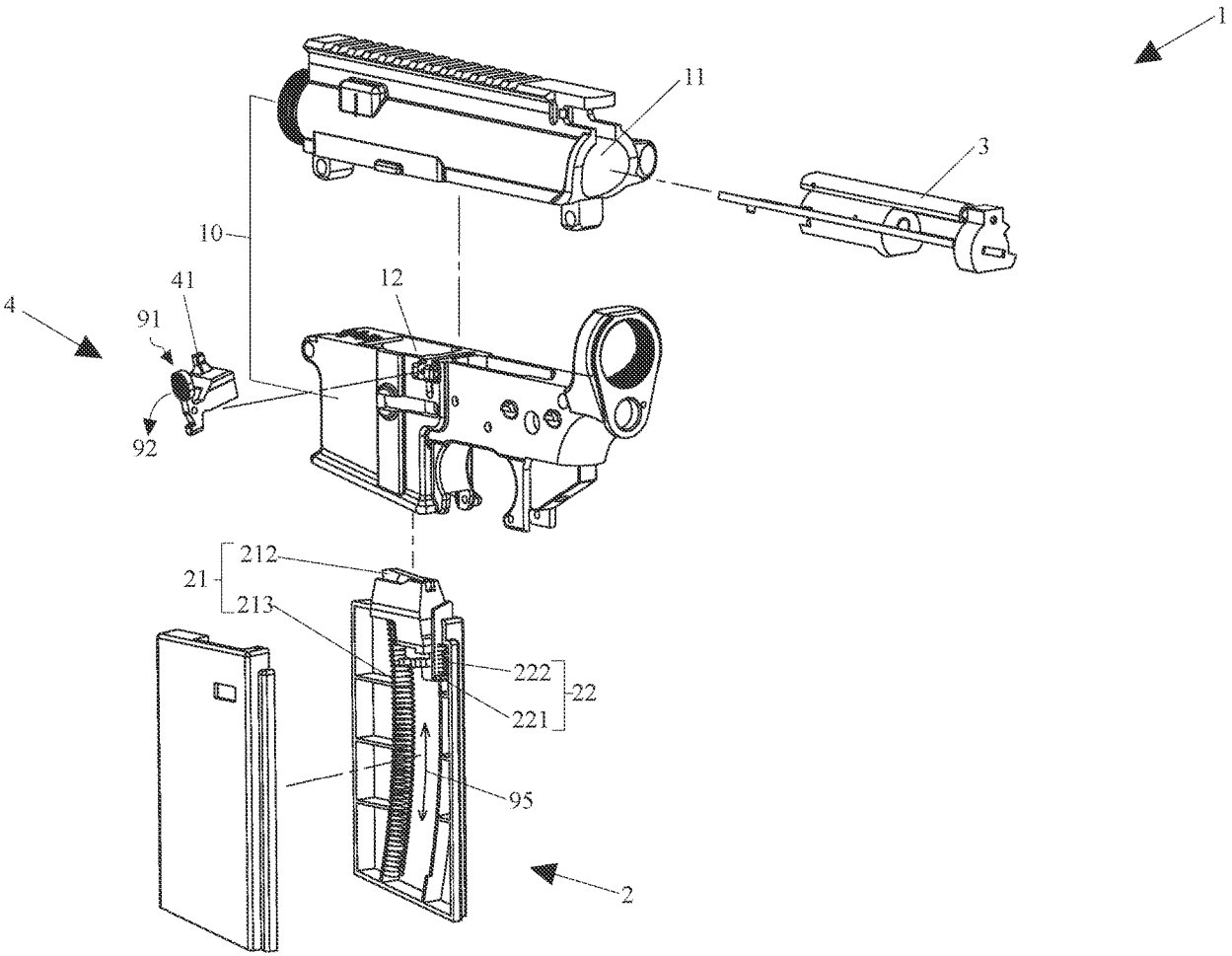
FIG. 1A is an exploded view of a gun device with bolt catch according to a preferred embodiment of the present invention.
Figure 1B:
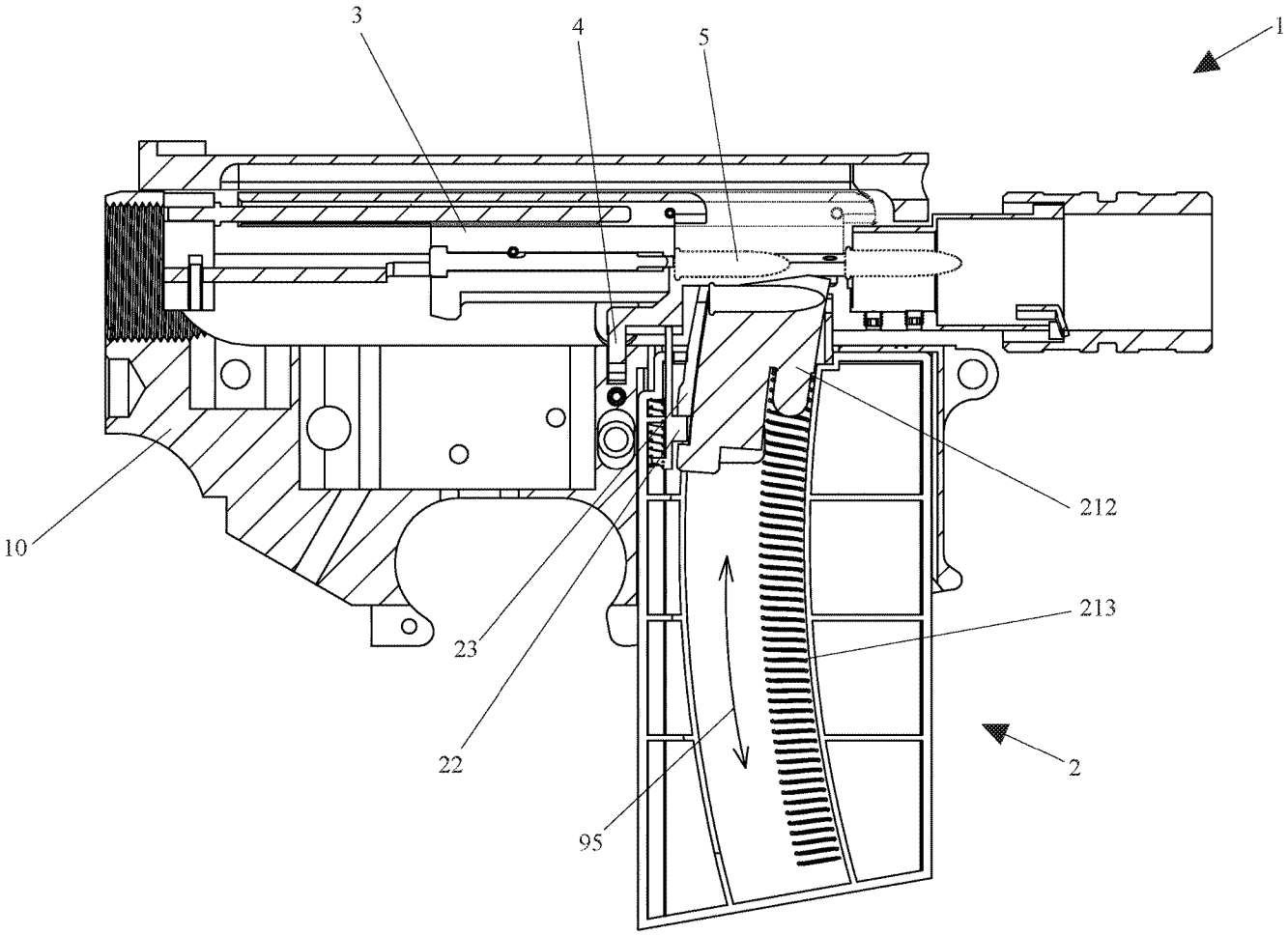
FIG. 1B is a cross-sectional view of the gun device with bolt catch according to the preferred embodiment of the present invention.

Referring to FIG. 1A and FIG. 1B, there are shown an exploded view and a cross-sectional view of a gun device with bolt catch according to a preferred embodiment of the present invention. The present invention provides a gun device 1 with bolt catch. The receiver 10 is adapted for use with an AR-15 (Armalite Rifle-15, AR15) automatic rifle. The receiver 10 comprises a bolt chamber 11 and a magazine well 12. An angle (not shown) is defined by and between the direction of extension of the bolt chamber 11 and the direction of extension of the magazine well 12. The angle is substantially a right angle, but the present invention is not limited thereto. The gun device 1 with bolt catch further comprises a magazine 2, a bolt 3, and a bolt catch 4.

Figure 2B:
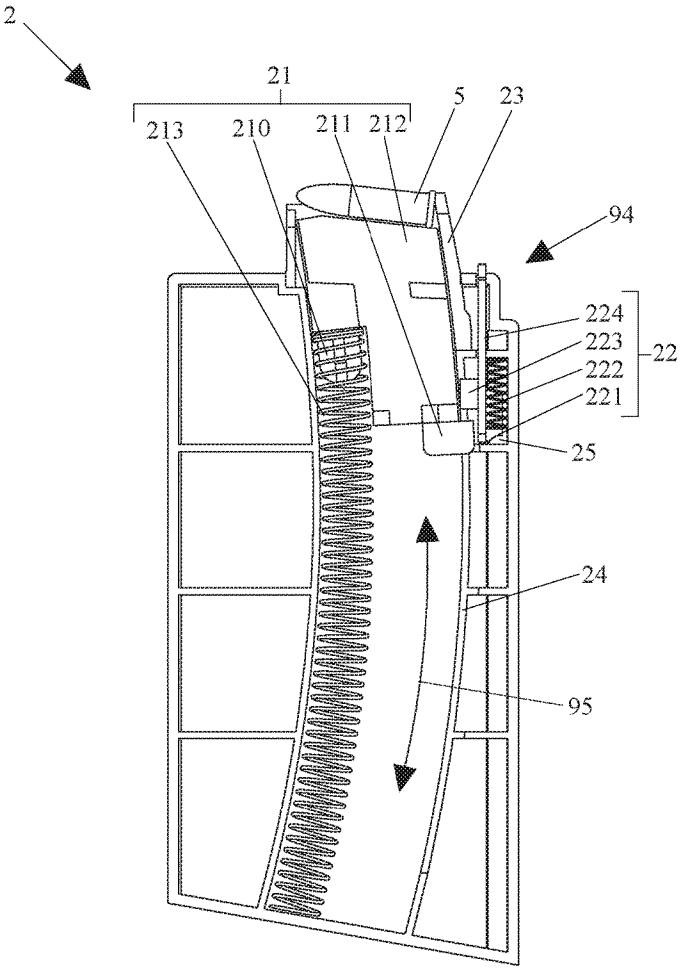
FIG. 2B is a cross-sectional view of the magazine, the follower is located at a second position according to the preferred embodiment of the present invention.
Figure 2A:
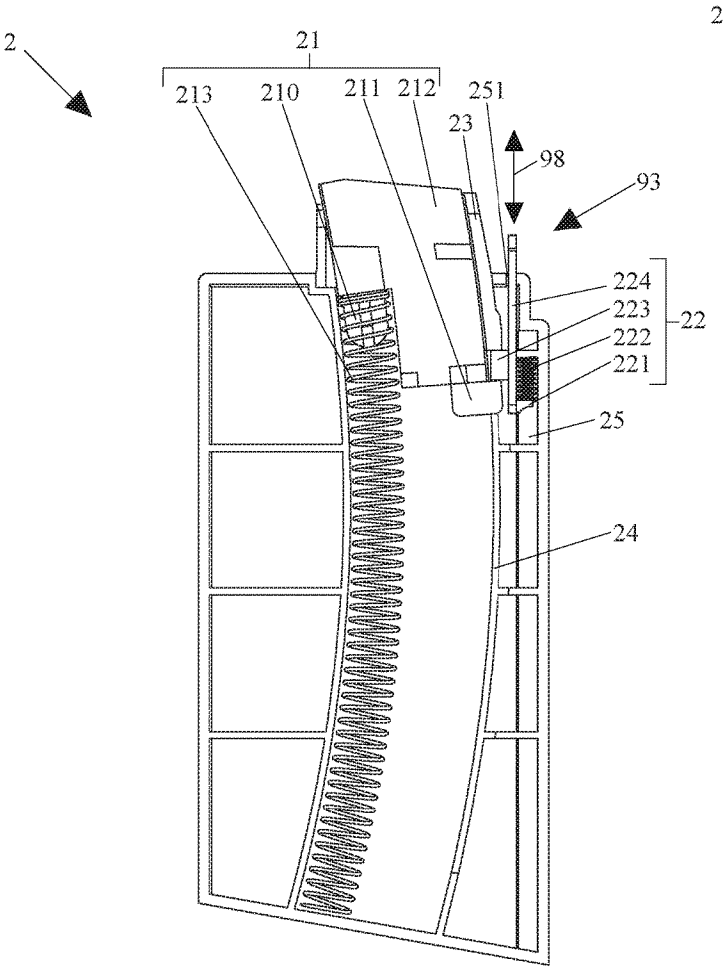
FIG. 2A is a cross-sectional view of a magazine, the follower is located at a first position according to the preferred embodiment of the present invention.
Figure 3A:
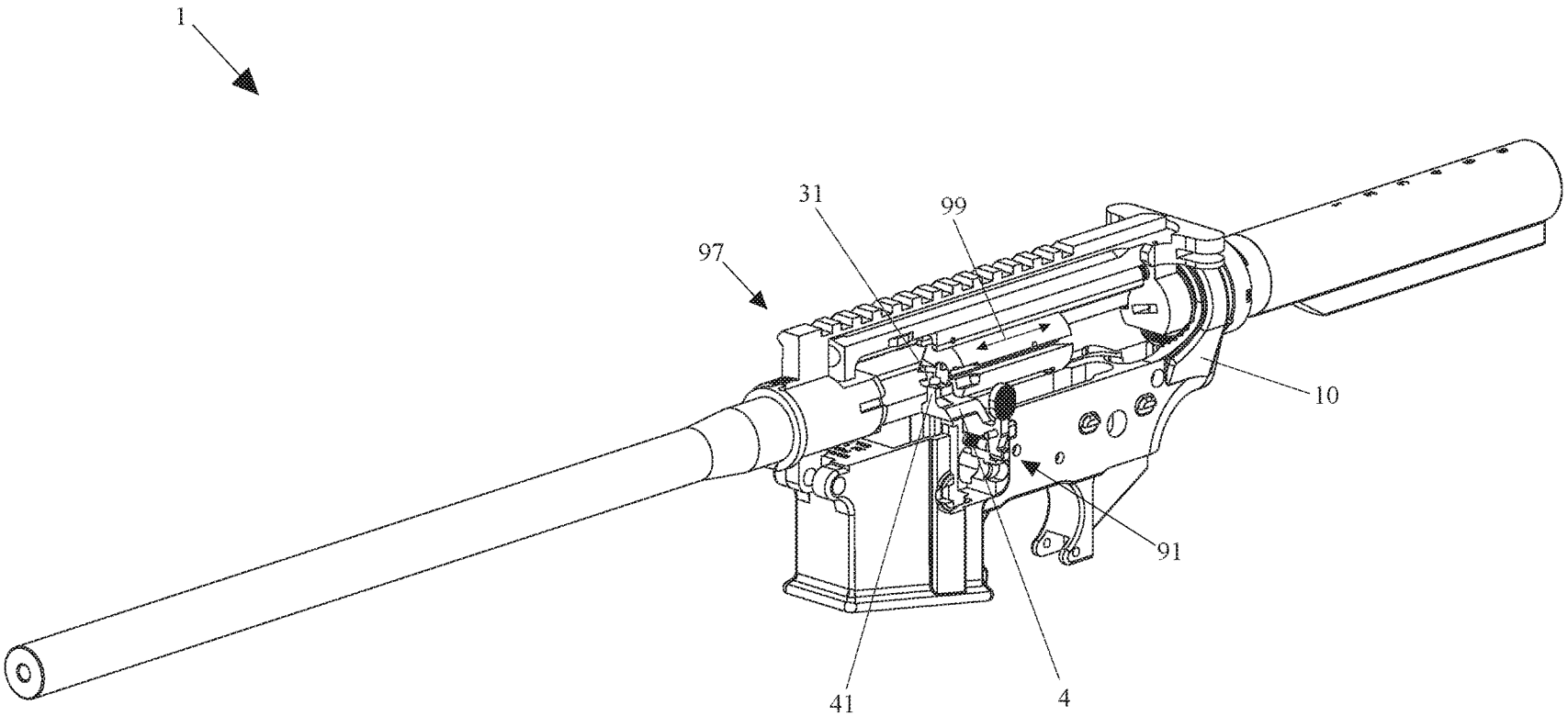
FIG. 3A is a cutaway view of a bolt catch located at an initial position according to the preferred embodiment of the present invention.
Figure 3B:
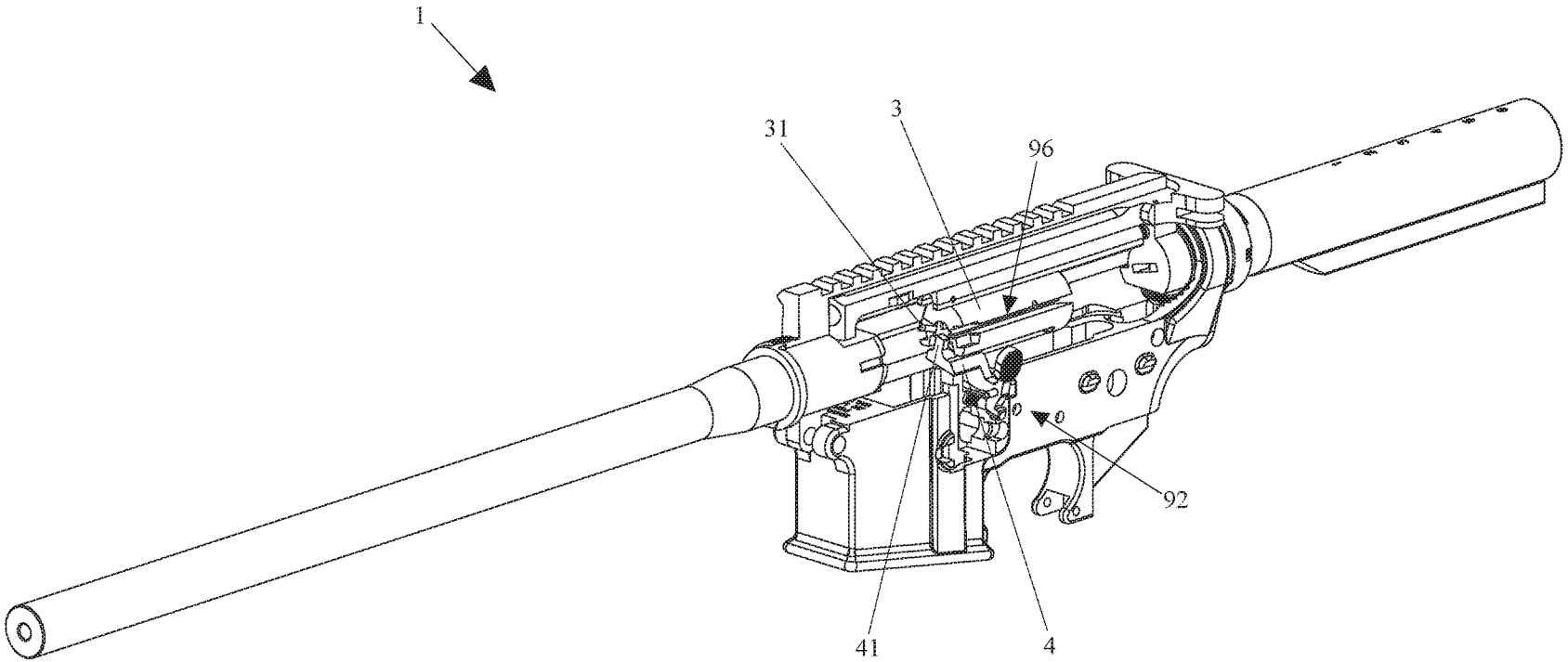
FIG. 3B is a cutaway view of the bolt catch located at an engaging position according to the preferred embodiment of the present invention.
Figure 4A:
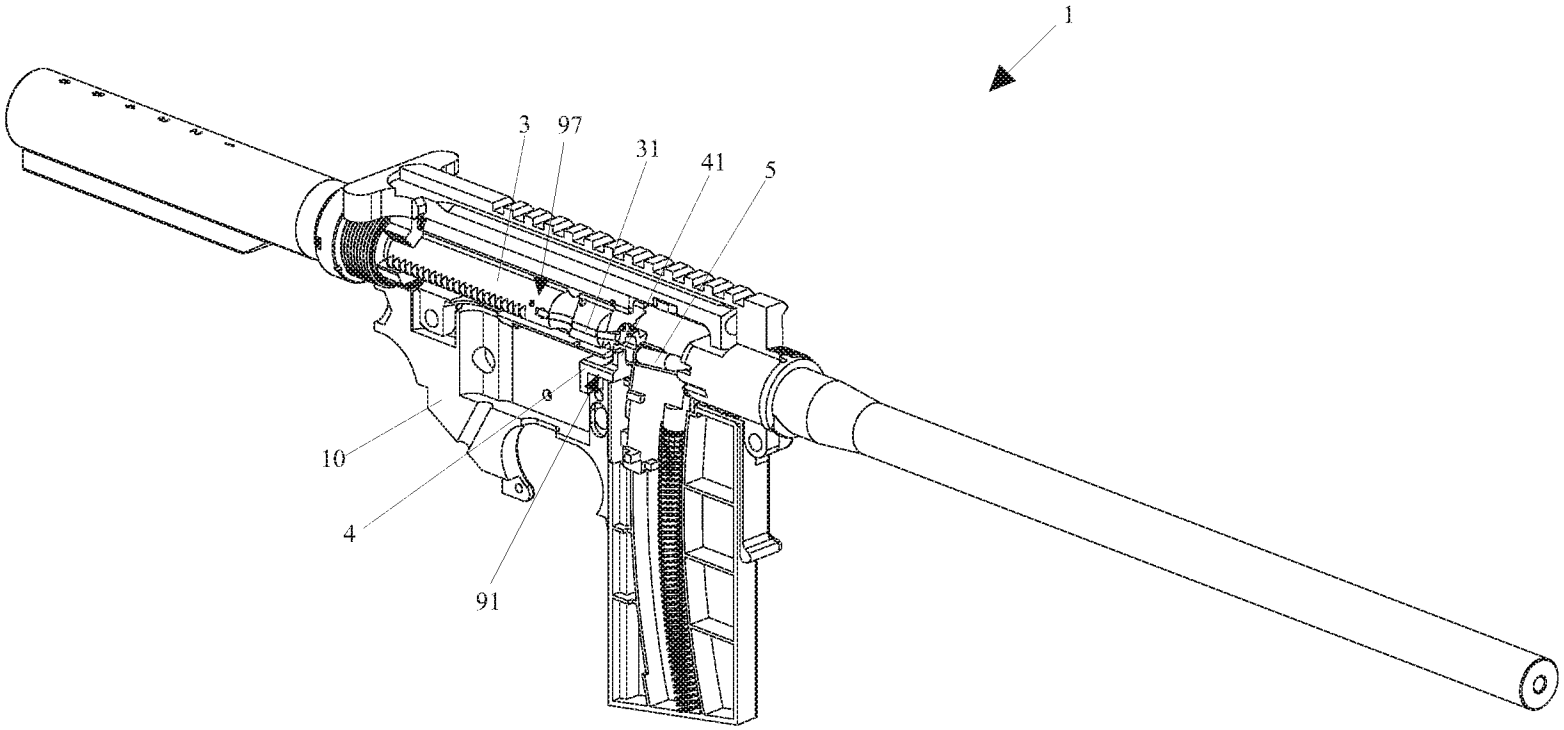
FIG. 4A is a cutaway view of a bolt located at a feed position according to the preferred embodiment of the present invention.
Figure 4B:
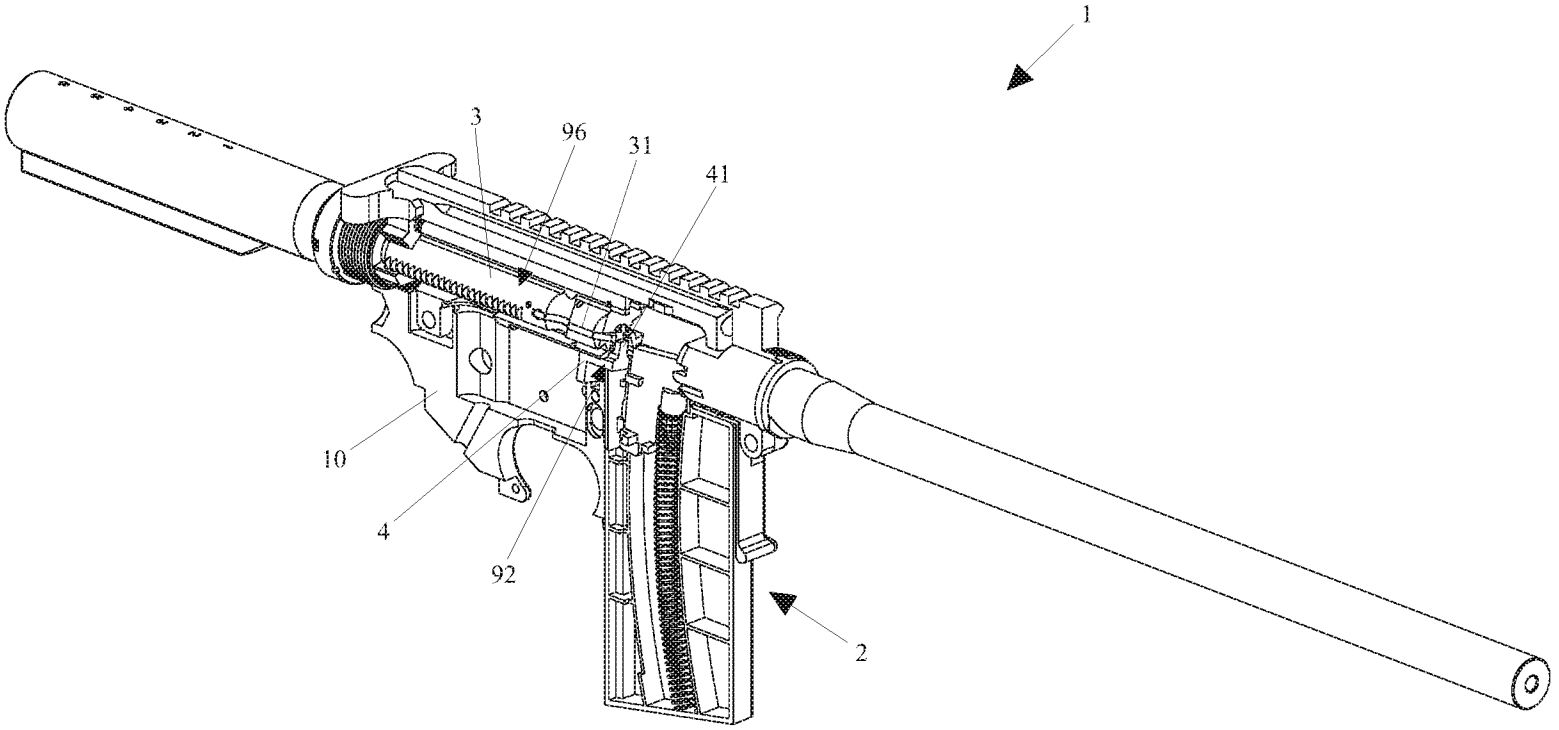
FIG. 4B is a cutaway view of the bolt located at an open position according to the preferred embodiment of the present invention.

Referring to FIG. 2A and FIG. 2B, there are shown cross-sectional views of the magazine 2, follower is located at a first position and a second position according to the preferred embodiment of the present invention, respectively. The peripheral dimension of the magazine 2 is a second specification magazine dimension. The magazine 2 is disposed in the magazine well 12 to connect integrally with the gun device 1. The second specification magazine dimension conforms with the shape of the cartridge cases of 5.56 mm caliber bullets applicable to AR-15 automatic rifles such that the bullets can be disposed in the magazine well 12.

The magazine 2 comprises a follower 21, a bolt lock trigger 22, a hollow 23, a rail 24, and a fixing chamber 25. The hollow 23 extends from the magazine 2 to receive the projectile 5 of the first caliber, where the projectile 5 is 0.22 inch caliber. The rail 24 is disposed in the magazine 2. One end of the rail 24 extends to the hollow 23. The follower 21 lies on the rail 24 while undergoing a linear displacement motion 95. The fixing chamber 25 is disposed in the magazine 2. The bolt lock trigger 22 is disposed in the fixing chamber 25.

In the preferred embodiment of the present invention, the follower 21 further comprises a top plate 212 and a resilient component 213. One end of the top plate 212 is flanked by a positioning body 210 and a tab 211. The tab 211 lies on the rail 24. The resilient component 213, which is a spring disposed in the magazine 2, has one end connected to the bottom of the magazine 2 and the other end connected to the positioning body 210. The top plate 212 undergoes the linear displacement motion 95 in the direction of extension of the resilient component 213 and confined to the rail 24.

In the preferred embodiment of the present invention, the bolt lock trigger 22 further comprises a baffle 224 and a resilient body 222. The baffle 224 is disposed in the fixing chamber 25 and extends from an opening 251 of the fixing chamber 25. The baffle 224 is flanked by a pressing body 221 and a guiding body 223. The resilient body 222 connects with the pressing body 221. The baffle 224 undergoes a second linear displacement motion 98 in the direction of extension of the resilient body 222 and confined to the opening 251.

With reference to the aforesaid structures and design, the use and operation of the present invention is described below. The follower 21 is located at either a first position 93 or a second position 94. When the follower 21 is located at the second position 94, the hollow 23 receives at least a projectile 5 of the first caliber, and the first caliber is 0.22 inch caliber; meanwhile, the tab 211 and the guiding body 223 are separate from each other, and, under a resilient force exerted by the resilient body 222, the pressing body 221 draws the baffle 224 substantially into the fixing chamber 25. When the follower 21 is located at the first position 93, the top plate 212 is positioned in the hollow 23; meanwhile, the tab 211 and the guiding body 223 are next to each other. The top plate 212 is disposed beside a peripheral surface of the follower 21 to press against the guiding body 223 under the resilient force exerted by the resilient component 213 such that the resilient body 222 enters a pressed state. Hence, the baffle 224 undergoes the second linear displacement motion 98 in a direction of extension of the resilient body 222 and confined to the opening 251, thereby allowing the bolt lock trigger 22 to extend from the magazine 2 by a height.

Referring to FIG. 3A, FIG. 3B and FIG. 4A, FIG. 4B, there are shown cutaway views of the bolt catch 4 located at an initial position and an engaging position, respectively, and the bolt 3 located at a feed position and an open position, respectively, according to the preferred embodiment of the present invention. In the preferred embodiment of the present invention, the bolt catch 4 comprises an engaging body 41. The bolt catch 4 is disposed on a lateral surface of the receiver 10, allowing the bolt catch 4 to be located at an initial position 91 and an engaging position 92. When the bolt catch 4 is located at the initial position 91, the bolt 3 is positioned in the bolt chamber 11 and undergoes a reciprocating linear displacement motion 99 in the direction of extension of the bolt chamber 11. Due to the bolt 3, the projectile 5 characterized by the first caliber and provided by the magazine 2 is loaded, fed to the barrel, and positioned in place. When fired, the projectile 5 is emitted from the barrel; then, an extractor 31 flings the cartridge case out of the receiver 10. At this point in time, under the recoil which results from the explosion of the projectile 5, the bolt 3 undergoes a linear displacement motion in the backward direction; then, when the explosion-induced recoil dies down, the bolt 3 undergoes a linear displacement motion in the forward direction under a restoring force, and in consequence the bolt 3 undergoes the reciprocating linear displacement motion 99 within the bolt chamber 11. Therefore, the bolt 3 is located at a feed position 97 whenever the projectile 5 of the first caliber is present in the magazine 2.

When the magazine 2 does not carry the projectile 5 of the first caliber, the bolt lock trigger 22 extends from the magazine 2 to abut against the bolt catch 4 such that the bolt catch 4 is located at the engaging position 92, whereas the engaging body 41 and the bolt 3 are next to each other such that the bolt 3 is fixed in place at an open position 96. Therefore, the bolt 3 is located at either the feed position 97 or the open position 96. When the bolt 3 is located at the feed position 97, the bolt catch 4 is located at the initial position 91. When the bolt 3 is located at the open position 96, the bolt catch 4 is located at the engaging position 92.

Referring to all the above diagrams, the present invention discloses a gun device 1 with bolt catch. The gun device 1 with bolt catch is applicable to the receiver of AR-15 automatic rifles such that the AR-15 automatic rifles can use 0.22 inch caliber bullets.

The above description shows sufficiently that the present invention is novel, involves inventive steps, and has high industrial applicability in terms of its objectives and advantages, thereby meeting the requirements of patentability. However, the above description is focused on a preferred embodiment of the present invention only and therefore is not restrictive of the present invention. All equivalent changes and modifications made to the preferred embodiment of the present invention according to the claims of the present invention should fall within the claims of the present invention.

What is claimed is:

1. A gun device with bolt catch, having a receiver comprising a bolt chamber and a magazine well, with an angle defined by and between a direction of extension of the bolt chamber and a direction of extension of the magazine well, comprising:

a magazine disposed in the magazine well and comprising:

a follower and a bolt lock trigger, wherein the bolt lock trigger comprises:

a baffle disposed in a fixing chamber, extended from an opening of the fixing chamber, and flanked by a pressing body and a guiding body; and a resilient body connected to the pressing body, wherein the baffle undergoes a second linear displacement motion in a direction of extension of the resilient body and confined to the opening;

a hollow part extending from the magazine;

a rail disposed in the magazine and having an end extended to the hollow part, wherein the follower lies on the rail while undergoing a linear displacement motion; and a fixing chamber disposed in the magazine and adapted to contain the bolt lock trigger;

a bolt disposed in the bolt chamber; and a bolt catch comprising an engaging body, with the bolt catch disposed through a lateral surface thereof on the receiver, allowing the bolt catch to be located at an initial position and an engaging position;

wherein, when the follower is located at a first position, not only is the follower positioned beside the bolt lock trigger such that the bolt lock trigger extends from the magazine by a height to thereby move the bolt catch, but the engaging body is also positioned beside the bolt to thereby position the bolt catch at the engaging position and fix the bolt in place at an open position; and wherein the bolt lock trigger extends from the magazine by the height such that the resilient body is compressed by the pressing body and thereby enters a pressed state.

2. The gun device with bolt catch of claim 1, wherein the follower further comprises:

a top plate with an end flanked by a positioning body and a tab, allowing the tab to lie on the rail; and a resilient component connected to the positioning body, wherein the top plate undergoes the linear displacement motion in a direction of extension of the resilient component and confined to the rail.

3. The gun device with bolt catch of claim 2, wherein, when the follower is located at the first position, the top plate is positioned in the hollow part and beside a peripheral surface of the hollow part.

4. The gun device with bolt catch of claim 1, wherein the bolt is located at either a feed position or the open position and located at the feed position when the bolt catch is located at the initial position.

5. The gun device with bolt catch of claim 1, wherein the bolt is adapted to position bullets and comprises an extractor for removing spent cartridge cases.

* * * * *